US005297444A

United States Patent [19]

Kriner et al.

[11] Patent Number: 5,297,444

[45] Date of Patent: Mar. 29, 1994

[54] TOGGLE ASSEMBLY

[75] Inventors: Robert L. Kriner, York, S.C.; David A. Stamps, Charlotte, N.C.

[73] Assignee: Gaston County Dyeing Machine Company, Stanley, N.C.

[21] Appl. No.: 940,488

[22] Filed: Sep. 4, 1992

[51] Int. Cl.[5] ..... A43C 11/00

[52] U.S. Cl. ..... 74/520; 292/256.69

[58] Field of Search ..... 74/520; 292/256.69

[56] References Cited

U.S. PATENT DOCUMENTS

| | | | |
|---|---|---|---|
| 625,573 | 5/1899 | Leavitt | 292/256.69 |
| 1,482,049 | 1/1924 | Swanson | 292/256.69 |
| 1,898,742 | 2/1933 | Phillips | 292/256.69 |
| 1,978,241 | 10/1934 | Wilcox | 292/256.69 |
| 2,304,911 | 12/1942 | Harpold | 292/256.69 |
| 2,574,281 | 11/1951 | Olson | 74/1 |
| 2,600,584 | 6/1952 | Snell | 77/63 |
| 2,950,767 | 8/1960 | Lemont, Jr. | 170/160.12 |
| 2,981,977 | 5/1961 | Fannen | 292/256.69 |
| 3,144,165 | 8/1964 | Pegon et al. | 292/256.69 |
| 3,213,707 | 10/1965 | McCann et al. | 74/520 |
| 3,310,329 | 3/1967 | Luker | 292/256.69 |
| 3,637,257 | 1/1972 | Uncapher | 292/256.69 |
| 3,892,138 | 7/1975 | Vomberg | 74/520 X |
| 4,385,423 | 5/1983 | Vermilye | 292/256.69 |
| 4,400,994 | 8/1983 | Sjkaeveland | 74/520 |

FOREIGN PATENT DOCUMENTS

| | | | |
|---|---|---|---|
| 2430712 | 1/1976 | Fed. Rep. of Germany | 292/256.69 |
| 623968 | 6/1928 | France | 292/256.69 |

*Primary Examiner*—Leslie A. Braun
*Assistant Examiner*—Ryan W. Massey
*Attorney, Agent, or Firm*—Shefte, Pinckney & Sawyer

[57] ABSTRACT

An improved toggle assembly for use in a band-type clamping closure assembly such as provided on a textile kier or like pressure vessel for securing a lid or cover in place during operation. The toggle assembly includes a first pair of lugs affixed to one end of the clamping band in laterally spaced facing relation and a second pair of lugs affixed to the other band end in laterally spaced facing relation. A toggle body has a pair of laterally spaced arm portions each pivotably affixed to a respective one of the first lugs and a handle portion extending outwardly from the arm portions. An actuating link is affixed pivotably at one end to each of the arm portions of the toggle body intermediately of the handle portion and the location at which the arm portions are pivoted to the first lugs and is affixed pivotably at the opposite end to each of the second lugs. Pivotal movement of the toggle body with respect to the first lugs actuates translatory movement of the actuating link for selective clamping and unclamping movement of the band ends toward and away from one another.

3 Claims, 7 Drawing Sheets

TOGGLE ASSEMBLY

BACKGROUND OF THE INVENTION

The present invention relates generally to toggle assemblies for selectively tightening and loosening clamping devices and, more particularly, to toggle assemblies for use in a band-type closure assembly for removably securing a door, lid or other closure member over an opening in a pressure vessel such as a textile dyeing kier.

Pressure vessels such as textile dyeing equipment optimally operate under considerable pressure and, accordingly, closure assemblies utilized to secure doors, lids or like covers over access openings into the interiors of such vessels should be constructed to facilitate easy opening and closing of such covers repetitively while also reliably withstanding normal operating pressures over an extended useful vessel life. For this purpose, kiers and similar textile dyeing apparatus have typically been equipped with mating annular flanges about the respective perimeters of access openings into the vessel interior and lids or other covers to be mounted thereon, with a closure assembly in the form of an elongate resilient clamping band mounted to the body of the pressure vessel about the access opening with the opposite ends of the band joined by a toggle assembly for selective clamping and unclamping of the lid and vessel flanges with respect to one another.

Optimally, such toggle assemblies should be of a mechanical design which is of a simple construction utilizing a minimal number of components while maximizing mechanical advantage in operation to provide ample clamping force and strength to easily withstand all operating pressures which may be encountered in normal use.

SUMMARY OF THE INVENTION

It is accordingly an object of the present invention to provide an improved toggle assembly which satisfies the foregoing design criteria so as to be especially adapted for use in band-type closure assemblies for pressurized textile dyeing vessels.

More particularly, in such embodiments, the toggle assembly of the present invention is affixed to the opposite ends of a clamping band for selectively drawing the band ends together to exert clamping force annularly about respective flanges of a door, lid or other closure member and an access opening into a kier or other pressure vessel when the closure member is disposed over the pressure vessel opening and for selectively moving the band ends sufficiently apart for removal of the closure member from the pressure vessel opening when desired.

Briefly summarized, in accordance with the present invention, the toggle assembly comprises a first pair of lugs affixed to a first one of the band ends in laterally spaced facing relation and a second pair of lugs affixed to the other of the band ends in similar laterally spaced facing relation. A togqle body having a pair of laterally spaced arm portions and a handle portion extending outwardly therefrom is affixed to the first pair of lugs by pivotal connection of each arm portion to a respective one of the first lugs. An actuating link is affixed pivotably at one end to each of the arm portions of the toggle body between the handle portion and the location at which the arm portions are pivoted to the first lugs, with the opposite end of the actuating link being pivotably affixed to each of the second lugs. In this manner, pivotal movement of the toggle body in opposite directions with respect to the first lugs, e.g., by manual operation of the handle portion of the toggle body, actuates translatory movement of the actuating link which, in turn, produces selective clamping and unclamping movement of the band ends toward and away from one another.

In the preferred embodiment of the present toggle assembly, each lug of the first and second pairs of lugs includes an ear portion which projects beyond its respective band end, with an opening being formed in each ear portion. In this manner, the first and second pairs of lugs at the opposite band ends are disposed to extend in overlapping relation to one another with their respective openings in alignment when the band ends are drawn together, which facilitates receipt of a safety pin through the aligned openings to prevent unintended separation of the band ends. The ear portions of the lugs are disposed symmetrically at the band ends so that, when the band ends are drawn together, the openings in the ear portions align with one another directly radially adjacent the band ends and intermediately of the location at which the arm portions are pivoted to the first lugs and the location at which the actuating link is pivoted to the second lugs, whereby the safety pin is located centrally in the toggle assembly. It is also preferred that the actuating link be equipped with an intermediate turnbuckle portion for fine adjustment of the effective operating length of the actuating link.

DESCRIPTION OF THE PREFERRED EMBODIMENT

Figure 1:
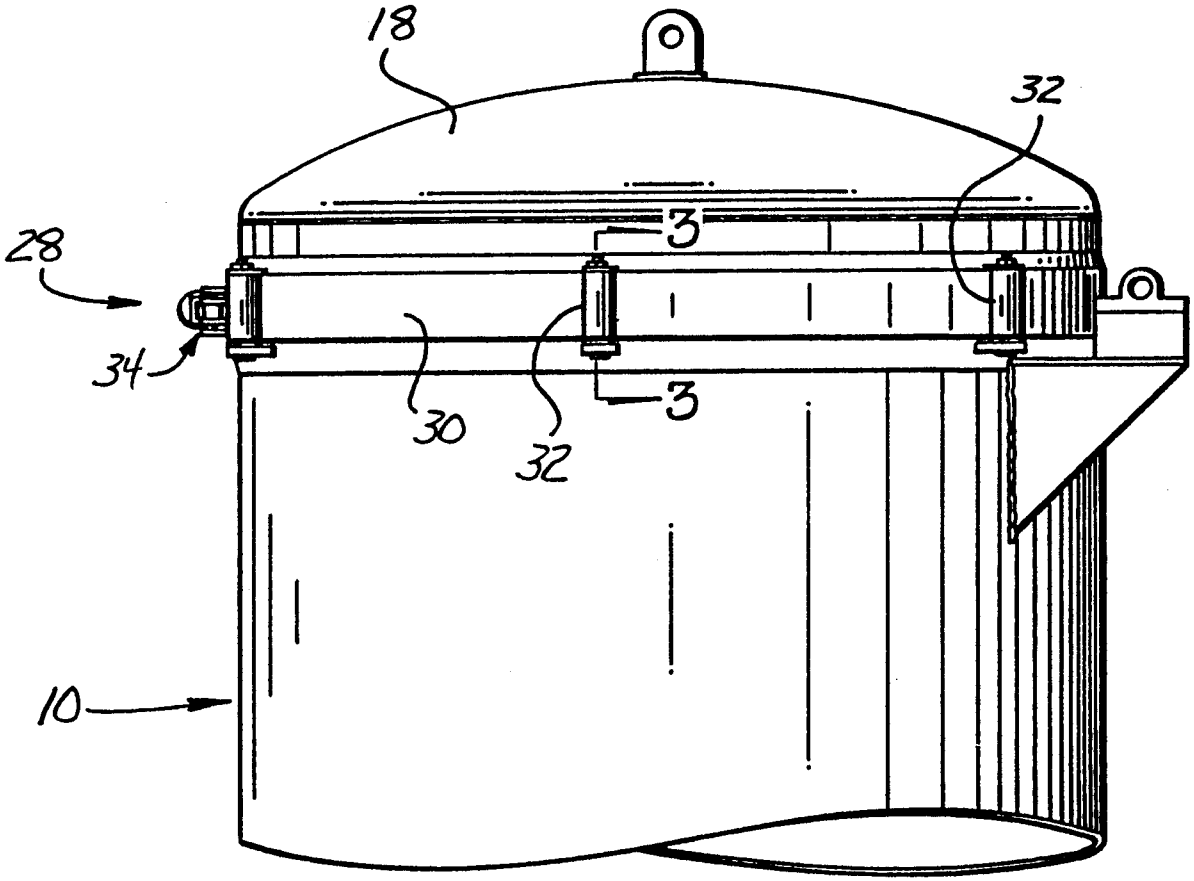
FIG. 1 is a partial side elevational view of a textile dyeing kier in the upper end region at which a pivotable lid is provided, showing the improved toggle assembly of the present invention as preferably embodied in a band-type closure assembly for the kier lid, the lid and the toggle assembly being depicted in their respective positions.
Figure 2:
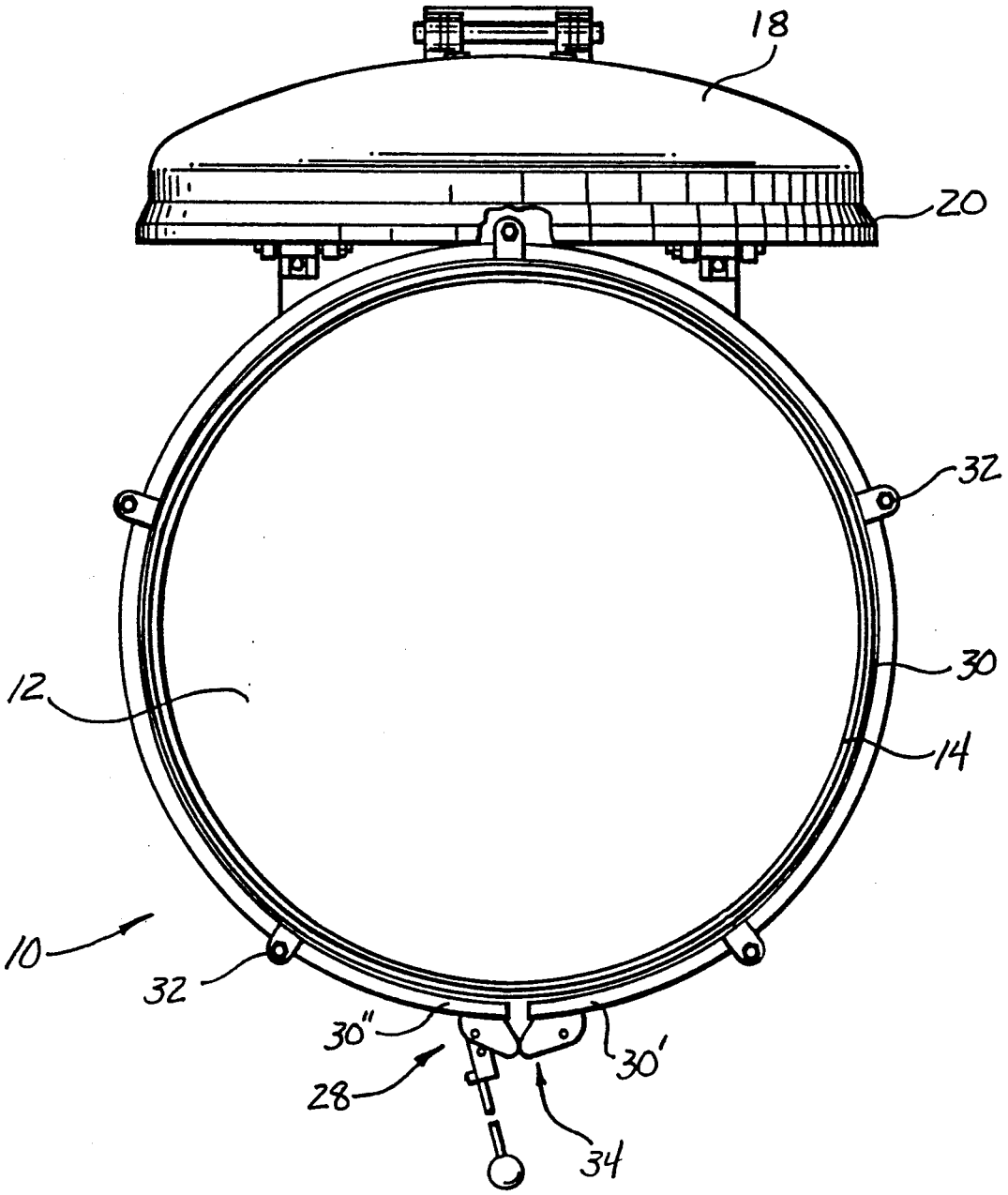
FIG. 2 is a top plan view of the kier and closure assembly of FIG. 1, with the lid and the toggle assembly in their respective open positions.

Referring now to the accompanying drawings and initially to FIGS. 1 and 2, an upright cylindrical vessel is shown generally at 10 as representative of textile kiers and other pressure vessels in general. The upper end of the pressure vessel 10 defines an access opening 12 into the vessel interior, the body of the vessel 10 being equipped with an annular rim 14 bordering the access opening 12 with an annular flange portion 16 (FIG. 3) extending radially outwardly from the rim 14. A circular lid or cover 18 is pivotably mounted to the body of the pressure vessel 10 adjacent the access opening 12 for pivoting movement into and out of covering relation to the opening 12. The lid 18 is equipped with a downwardly projecting annular rim 20 corresponding in size and shape to the rim 14 at the upper end of the vessel 10 for abutment of the rims 14,20 in the closed position of the lid 18. The rim 20 is formed with downwardly facing annular groove 22 in which a circular sealing gasket 24 is fitted for sealing contact with the rim 14. The rim 20 also includes an annular flange portion 16 (FIG. 3) projecting radially outwardly therefrom to be disposed in close adjacency to the flange portion 16 of the vessel rim 14 in the closed position of the lid 18.

A closure assembly, indicated as a whole at 28, is provided on the body of the vessel 10 annularly about its rim 14 for selectively clamping and unclamping the lid 18 with respect to the vessel 10 when the lid 18 is disposed in its closed position. Specifically, the closure assembly 28 includes an elongate flexible clamping band 30 supported and held in a circular configuration encircling the vessel rim 14 by a plurality of retainer units 32 affixed to the rim 14 at annular spacings thereabout, with the opposite ends 30',30" of the clamping band 30 being connected by a toggle assembly, generally indicated at 34, operative for selectively moving the band ends toward and away from one another for clamping and unclamping action as more fully explained below. The band 30 is affixed to one of the retainer units located diametrically opposite the toggle assembly 34 to prevent shifting movement of the closure assembly 28 upon operation of the toggle assembly 34.

Figure 3:
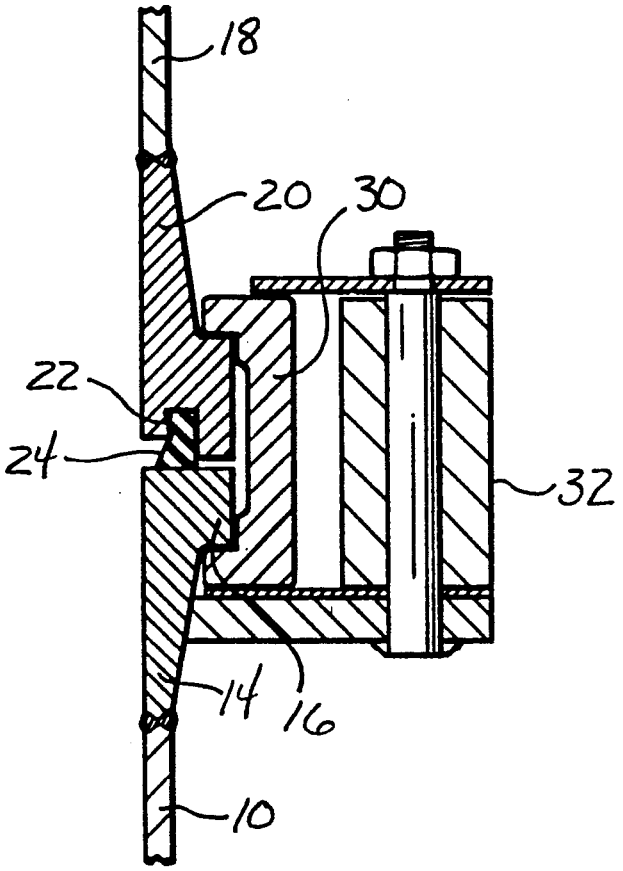
FIG. 3 is a fragmentary vertical cross-sectional view taken along line 3—3 of FIG. 1.

As best seen in FIG. 3, the clamping band 30 is of a substantially C-shaped cross-section configured in conformity to the collective shape and dimension of the flange portions 16,26 of the respective vessel and lid rims 14,20 when adjacent one another in the closed position of the lid 18. Thus, upon operation of the toggle assembly 34 to draw the opposite ends 30',30" of the band 30 together in the closed disposition of the lid 18, the band 30 securely encloses the respective flange portions 16,26 of the vessel and lid rims 14,20 both circumferentially thereabout and on opposite axial sides of the flange portions 16,26 to exert a clamping force thereon sufficient to retain the lid 18 in the closed position against internal pressure which may be generated within the vessel 10. On the other hand, the toggle assembly 34 is effective when operated to move the opposite band ends 30',30" away from one another to effectively increase the internal diameter of the band 30 sufficiently to permit pivoting movement of the lid 18 upwardly from its closed position into its open position of FIGS. 1 and 2 without obstruction by the closure assembly 28.

Figure 7:
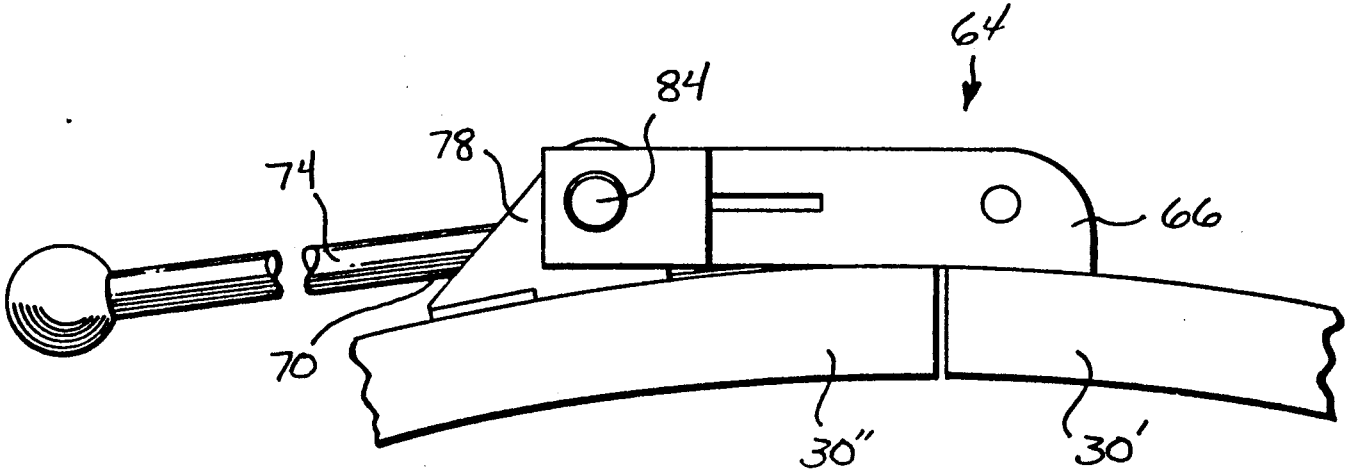
Fig. 7 Prior Art
FIG. 7 is an enlarged top plan view, similar to FIG. 6, showing a representative, prior art toggle assembly of the type conventionally textile dyeing kiers.
Figure 8:
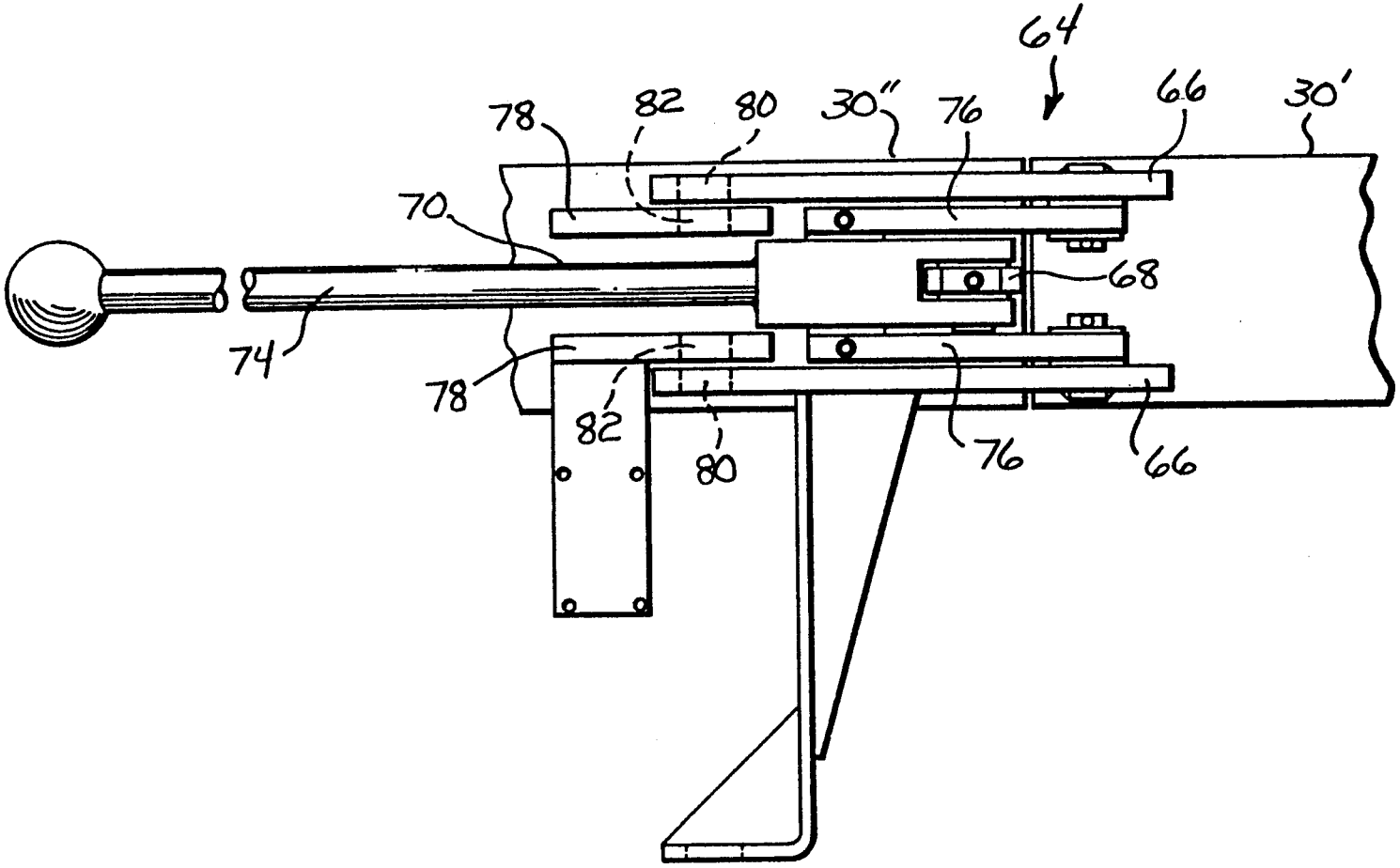
Fig. 8 Prior Art
FIG. 8 side elevational view of the prior art toggle assembly of FIG. 7.

To the extent thus far described, the construction and operation of the vessel 10 and the closure assembly 28 is conventional, the present invention residing in the particular construction of the toggle assembly 34. For sake of comparison with the toggle assembly 34, a typical toggle assembly of the prior art is illustrated in Figs. 7 and 8 at 64. The prior art toggle assembly 64 basically includes a pair of mounting lugs 66 affixed rigidly to and extending outwardly from and beyond opposite lateral sides of one band end 30' and a single mounting lug 68 affixed rigidly to the other band end 30" centrally of its widthwise extent. A toggle body 70 has a mounting yoke 72 at one end and an operating handle 74 at its opposite end, with the mounting yoke 72 being pivotably affixed to the single lug 68 on the band end 30". A pair of connecting links 76 are pivotably attached at their opposite ends respectively to opposite sides of the mounting yoke 72 adjacent its pivot connection to the lug 68 and to the lugs 66 at corresponding locations thereon overlying the band end 30'. Thus, manual pivotal movement of the handle 74 about the pivot point at which the mounting yoke 72 is connected to the single lug 68 acts through the connecting links 76 and the lugs 66 to draw the band ends 30',30" together or move them apart, depending upon the direction in which the handle 74 is pivoted. In the disposition of the handle 74 extending away from the band end 30' to overlie the band end 30" as shown in FIGS. 7 and 8, the band ends 30',30" are drawn together to exert a clamping force through the band 30 on the flange portions 16,26 of the vessel and lid rims 14,20. The mechanical orientation of the operating components of the toggle assembly in this disposition will tend to resist unclamping movement of the handle 74.

As an additional safety measure to prevent accidental or otherwise unintended unclamping pivotal movement of the handle 74 during pressurized operation of the vessel, a pair of auxiliary lugs 78 are affixed to the end 30" of the band 30 at a short spacing from the mounting lug 68 for disposition in overlapping relation with the outwardly extending ends of the mounting lugs 66 of the opposite band end 30' when the toggle assembly 64 is in its closed clamping disposition of FIGS. 7 and 8. The toggle mounting lugs 66 and the auxiliary lugs 78 are formed with respective openings 80,82 which align with one another in the closed clamping disposition of the toggle assembly 64 for receipt therethrough of a removable locking pin 84. The function of the locking pin 84 is to maintain the toggle assembly 64 in the closed clamping disposition even if one of the pivot pins connecting the toggle mounting yoke 72 and the mounting lugs 66,68 fail during operation.

In this regard, one of the disadvantages of the prior art toggle assembly 64 is that the single mounting lug 68 and the pivot pin by which it is connected to the mounting yoke 72 of the toggle body 70 provide the only means by which the toggle assembly per se is affixed to the band end 30" and thereby represents a potential point of weakness in the toggle assembly 64 at which shear forces could potentially cause its failure. Another disadvantage is the necessity of providing the two auxiliary lugs 78 to facilitate locking of the toggle assembly 64 by the locking pin 84 but without the auxiliary lugs 78 otherwise serving any function in the normal operation of the toggle assembly 64. Thus, the auxiliary lugs 78, together with the necessity that the mounting lugs 66 be elongated to reach the auxiliary lugs 78 in the closed disposition of the toggle assembly, increases the number of mechanical components and the overall size of the toggle assembly 64 beyond that actually necessary for operative opening and closing movement of the toggle assembly 64. Finally, while it would normally be desirable to configure the toggle assembly 64 so as to maximize within practical limits the spacing between the pivot point of the toggle mounting yoke 72 to the lug 68 on the band end 30" and the pivot point of the connecting links 76 to the lugs 66 on the band ends 30' in order to optimize the mechanical advantage of the toggle assembly 64 in clamping operation, these pivot points are relatively closely spaced in the toggle assembly 64 for space considerations.

Figure 4:
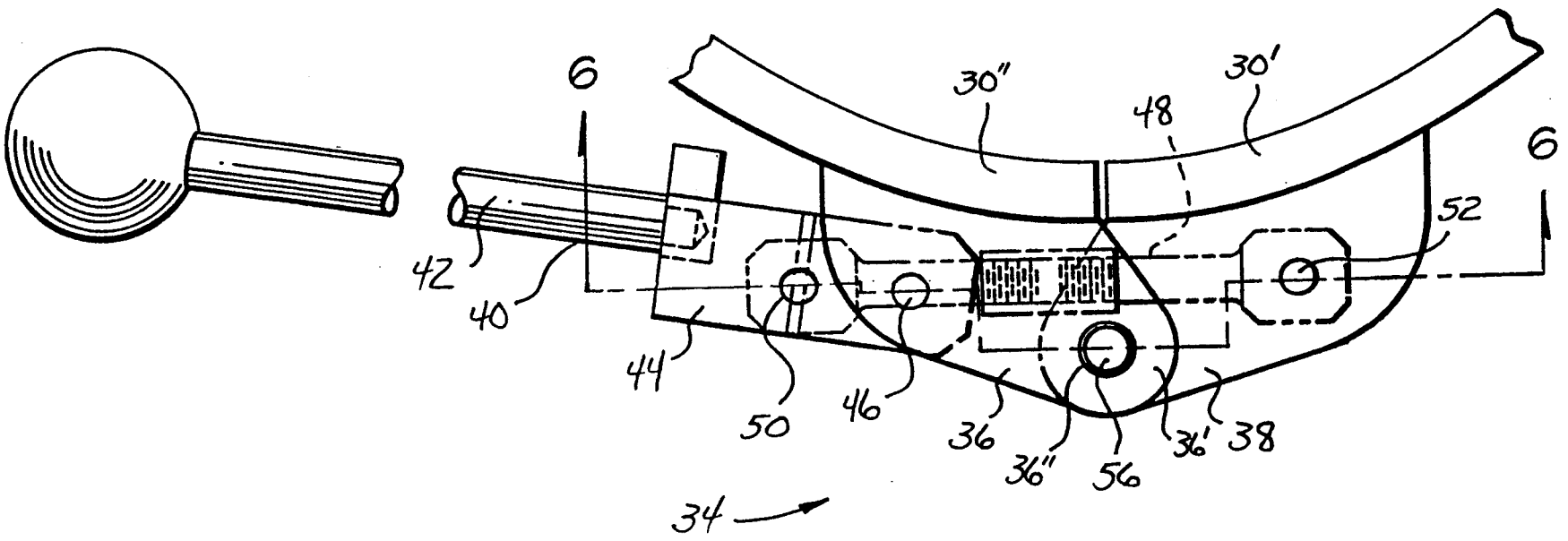
FIG. 4 an enlarged top plan view of the toggle assembly of the invention in its closed lid clamping position of FIGS. 2.
Figure 5:
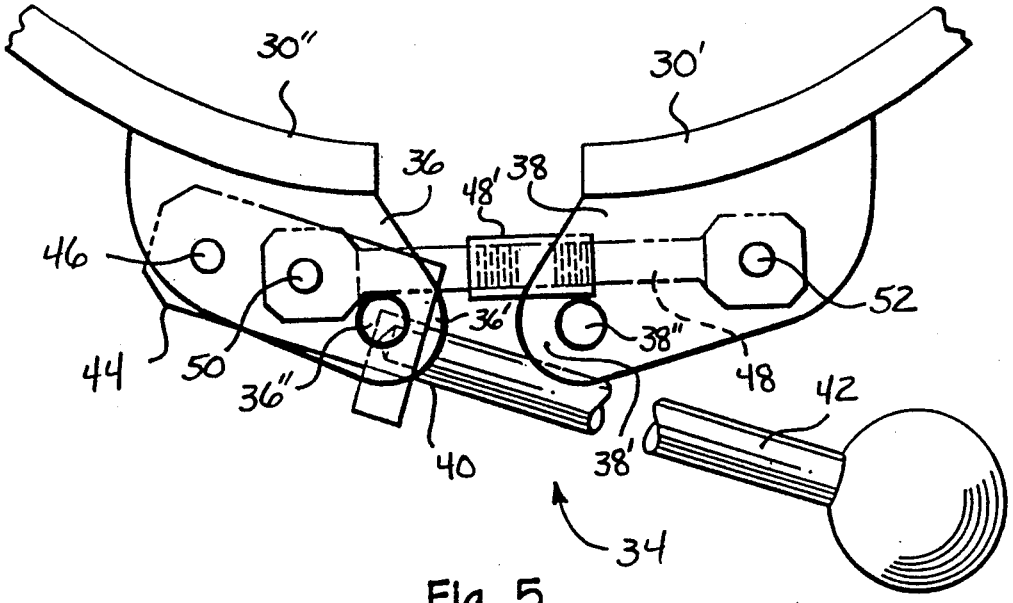
FIG. 5 is another enlarged top plan view of the present toggle assembly similar to FIG. 4 but showing the toggle assembly in its open position.
Figure 6:
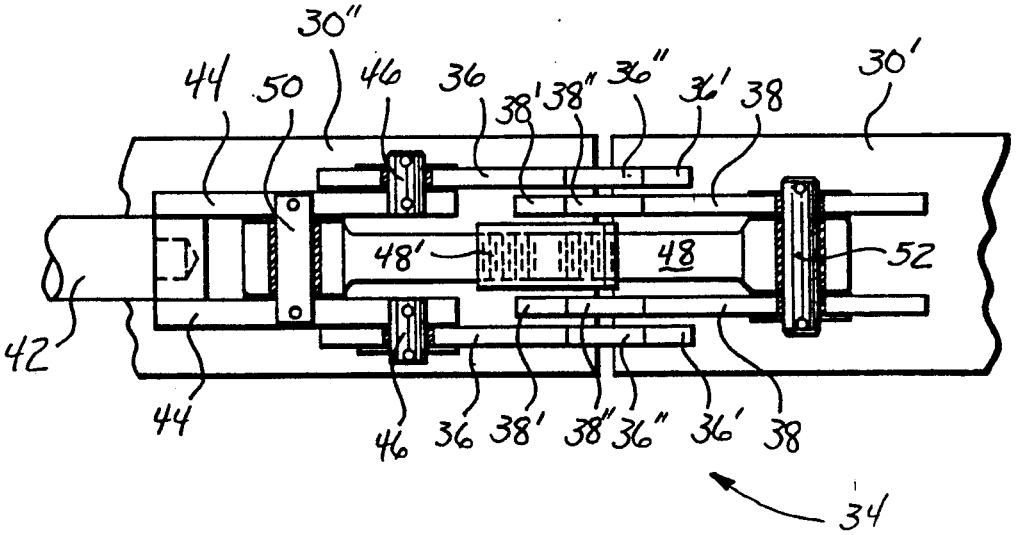
FIG. 6 is a vertical cross-sectional view of the present toggle assembly in its closed lid-clamping position of FIG. 4, taken along line 6—6 thereof.

In contrast, the toggle assembly 34 of the present invention overcomes these disadvantages of the prior art toggle assembly 64 while at the same time providing a simplified and more compact construction. With reference to FIGS. 4–6, the present toggle assembly 34 includes a first pair of mounting lugs 36 affixed to the end 30'' of the clamping band 30 in laterally spaced parallel relation at opposite sides thereof. A second pair of mounting lugs 38 is similarly affixed to the other band end 30' in slightly more closely spaced parallel relation. A toggle body 40 has an elongate handle portion 42 with a pair of laterally spaced arms extending in parallel relation from one end of the handle portion 42. Each arm 44 is pivoted to a respective one of the first pair of lugs 36 by a respective pivot pin 46. A single actuating link 48 in the form of a dual-ended eyebolt extends centrally through the toggle assembly 34 between the arms 44 and the second pair of lugs 38, with one end of the actuating link 48 being pivoted to the arms 44 of the toggle body 40 by a pivot pin 50 and the opposite end of the actuating link 48 being pivoted to each of the second pair of lugs 38 by a pivot pin 52. Preferably, the actuating link 48 includes a threaded turnbuckle portion 48' centrally along its length for fine adjustment of the lengthwise dimension of the actuating link 48.

Each of the mounting lugs 36,38 is of identical configuration, the respective pairs of lugs 36,38 being oriented in mirror-image relation to one another. Each lug 36,38 includes an ear portion 36',38', respectively, in the form of a rounded lobe which projects lengthwise beyond the respective band end 30',30'' so that, by virtue of the differential spacing of the respective lug pairs 36,38, the ear portions 36',38' overlap one another when the band ends 30',30'' are drawn together in the closed clamping disposition of the toggle assembly 34. The ear portions 36',38' are formed with respective openings 36'',38'' which align with one another in the closed clamping disposition of the toggle assembly 34 to receive a locking pin 56.

Operation of the present toggle assembly 34 will thus be understood from FIGS. 4–6 wherein the open disposition of the toggle assembly is shown in FIG. 5 and the closed disposition of the toggle assembly is shown in FIGS. 4 and 6. As seen in FIG. 5, in the open disposition, the toggle body 40 is pivoted about the pivot pins 50 in a counterclockwise direction (as viewed in top plan of FIG. 5) to extend alongside the band end 30', the toggle body 40 acting through the actuating link 48 to force the band ends 30',30'' apart sufficiently to enlarge the overall effective inner diameter of the closure assembly 28 to free the flange portion 26 of the vessel lid 18 for unobstructed upward and downward pivoting movement on the vessel 10. Reverse pivoting movement of the toggle body 40 by manual operation of the handle portion 42 in the clockwise direction of approximately 180° about the pivot pin 46 produces a corresponding translatory movement of the actuating link 48 to draw the pivot pins 46,52 and, in turn, the band ends 30',30'' toward one another until the toggle body 40 reaches a resting "over center" disposition extending along the band end 30''. In this closed clamping disposition of the toggle assembly 34, the band 30 is drawn tightly into circumferential and axial engagement with the respective flange portions 16,26 of the vessel and lid rims 14,20 to clamp the sealing gasket 24 into sealed engagement with the flange portion 16 and to resist unintended separation of the flange portions 16,26. The respective openings 36'',38'' through the mounting lugs 36,38 are aligned for receipt of the locking pin 56 as a safety measure to ensure the toggle assembly 34 remains in the closed clamping disposition against unintended opening movement of the toggle body 40, as aforementioned.

Advantageously, in contrast to the prior art toggle assembly 64 of FIGS. 7 and 8, the improved toggle assembly 34 of the present invention, in providing a pair of mounting lugs 36,38 on each band end 30',30'', ensures that each pivot axis of the toggle assembly 34 defined by the respective pivot pins 46,52 is supported at two mounting lugs to improve the stability and strength of the toggle assembly 34 over the toggle assembly 64. In addition, the provision of two pairs of mounting lugs 36,38 and the eyebolt form of actuating link 48 enables the pivot pins 46,52 to be selectively spaced relatively farther apart from one another than the pivot points on the lugs 66,68 in the prior art toggle assembly 64, so as to achieve a correspondingly enhanced mechanical advantage and increased clamping strength while still providing a more compact construction. In addition, the mirror-image configuration of the mounting lugs 36,38 enables the locking pin 56 to be received centrally of the toggle assembly 34 without the necessity of providing any auxiliary lug or lugs, which further contributes to the simplification and compactness of the toggle assembly 34.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a closure assembly for removably securing a closure member over an opening in a pressure vessel wherein said closure member and said pressure vessel have cooperating annular flanges, said closure assembly comprising a clamping band having opposite band ends and being formed into a substantially annular shape with said band ends in adjacent facing relation for encircling said flanges, and a toggle assembly affixed to said opposite band ends for selectively drawing said band ends together to exert clamping force annularly about the respective said flanges of said closure member and said pressure vessel when said closure member is disposed over said pressure vessel opening and selectively moving said band ends sufficiently apart for removal of said closure member from said pressure vessel opening, the improvement wherein said toggle assembly comprises a first pair of lugs affixed to a first one of said band ends in laterally spaced facing relation, a second pair of lugs affixed to the other of said band ends in laterally spaced facing relation, a toggle body having a pair of laterally spaced arm portions each pivotably affixed to a respective one of said first lugs and a handle portion extending outwardly from said arm portions, and an actuating link affixed pivotably at one end to each of said arm portions of said toggle body intermediately of said handle portion and the location at which said arm portions are pivoted to said first lugs and affixed pivotably at an opposite end to each of said second lugs, whereby pivotal movement of said toggle body with respect to said first lugs actuates translatory movement of said actuating link for selective clamping and unclamping movement of said band ends toward and away from one another, each lug of said first and second pairs of lugs including an ear portion projecting beyond its respective band end with an opening in said ear portion for disposition of said first and second pairs of lugs in overlapping relation with their respective openings in alignment with one another when said band ends are drawn together, thereby to facilitate receipt of a safety locking pin in said aligned openings to prevent unintended separation of said band ends.

2. An improved toggle assembly according to claim 1 wherein said openings in said ear portions are disposed to align with one another directly radially adjacent said band ends and intermediately of the location at which said arm portions are pivoted to said first lugs and the location at which said actuating link is pivoted to said second lugs when said band ends are drawn together.

3. An improved toggle assembly according to claim 1 wherein said actuating link includes an intermediate turnbuckle portion.

* * * * *

UNITED STATES PATENT AND TRADEMARK OFFICE

CERTIFICATE OF CORRECTION

PATENT NO. : 5,297,444

DATED : March 29, 1994

INVENTOR(S) : Robert L. Kriner and David A. Stamps

It is certified that error appears in the above-identified patent and that said Letters Patent is hereby corrected as shown below:

Column 1, line 60, delete "togqle" and insert therefor -- toggle --.

Column 2, line 39, after "respective" insert -- closed --.

Column 2, line 46, after "4" insert -- is --.

Column 2, line 47, after "the" insert -- present --.

Column 2, line 48, after "FIGS." insert -- 1 --.

Column 2, line 56, after "representative" delete ",".

Column 2, line 57, after "conventionally" insert -- used in --.

Column 2, line 58, after "8" insert -- is a --.

Column 3, line 11, after "with" insert -- a --.

Signed and Sealed this

Sixth Day of September, 1994

*Attest:*

Bruce Lehman

BRUCE LEHMAN

*Attesting Officer*

*Commissioner of Patents and Trademarks*